US008004198B2

(12) United States Patent
Bakre et al.

(10) Patent No.: US 8,004,198 B2
(45) Date of Patent: Aug. 23, 2011

(54) RESETTING AN ELECTRONIC BALLAST IN THE EVENT OF FAULT

(75) Inventors: Shashank Bakre, Woburn, MA (US); Nitin Kumar, Burlington, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 334 days.

(21) Appl. No.: 12/474,080

(22) Filed: May 28, 2009

(65) Prior Publication Data

US 2010/0301752 A1 Dec. 2, 2010

(51) Int. Cl.
*H05B 37/02* (2006.01)

(52) U.S. Cl. ..... 315/86; 315/224; 315/360; 315/247; 315/308

(58) Field of Classification Search ..... 315/86, 315/224, 225, 247, 291, 294, 307–309, 360
See application file for complete search history.

(56) References Cited

U.S. PATENT DOCUMENTS 5,652,479 A * 7/1997 LoCascio et al. ..... 315/225
6,339,296 B1 * 1/2002 Goral ..... 315/86
7,312,588 B1 * 12/2007 Yu et al. ..... 315/291
7,880,391 B2 * 2/2011 Bakre et al. ..... 315/86
2003/0076053 A1 4/2003 Kambara et al.
2006/0170372 A1 8/2006 Heckmann et al.
2006/0232224 A1 10/2006 Heckmann et al.
2007/0296355 A1 * 12/2007 Hamamoto et al. ..... 315/309

FOREIGN PATENT DOCUMENTS

WO 02/33502 A1 4/2002

* cited by examiner

*Primary Examiner* — Douglas W Owens
*Assistant Examiner* — Amy Yang
(74) *Attorney, Agent, or Firm* — Shaun P. Montana

(57) ABSTRACT

A ballast for driving one or more lamps includes a controller and a current reduction circuit for accelerating a controller reset. Upon detecting a fault, the controller disables the ballast for a preset period of time, and resets. The controller additionally resets when the ratio of a supplied second value to a supplied first value falls below a threshold value. The current reduction circuit reduces the supplied second value in less than the preset period of time, such that the ratio falls below the threshold value and the controller resets. An emergency lighting system includes the ballast as a primary ballast, a backup ballast, and a primary power source. The controller detects a fault if the primary power source de-energizes and the backup ballast disconnects the one or more lamps from the primary ballast. The current reduction circuit accelerates the reset of the controller when the primary power source de-energizes.

12 Claims, 4 Drawing Sheets

RESETTING AN ELECTRONIC BALLAST IN THE EVENT OF FAULT

CROSS-REFERENCE TO RELATED APPLICATIONS

Co-invented and co-owned U.S. patent application Ser. No. 12/474,049, filed simultaneously herewith, entitled "Electronic Ballast Control Circuit," is incorporated herein by reference in its entirety. In addition, co-invented and co-owned U.S. patent application Ser. No. 12/474,141, filed simultaneously herewith, entitled "Relamping Circuit for Dual Lamp Electronic Ballast," is incorporated herein by reference in its entirety.

FIELD OF THE INVENTION

The invention generally relates to electronic ballasts for providing power to one or more lamps. More particularly, the invention is concerned with quickly restarting the ballast in response to a power toggle.

BACKGROUND OF THE INVENTION

Ballasts provide power to one or more lamps and regulate the current, voltage, and/or power provided to the lamps. The ballast often contains one or more controllers, integrated circuits and other active and passive components to regulate the power provided to the lamp. Faults can disrupt ballast operation. For example, a momentary power interruption, such as the power source de-energizing and re-energizing, can affect continuous ballast operation. In some ballasts, the event of a power toggle results in the controller, which drives the power circuitry in the ballast, to detect a fault and inactivate the ballast until the controller resets. The reset of the controller occurs after a preset period of time has passed. A controller reset 'restarts' the controller to its initial power-up state, such that the controller begins its start-up cycle. The ballast remains off during this preset period of time, and power is not provided to the lamp until the controller completes the reset. The reset period of time is typically determined by the capacitive discharge of the power circuitry.

SUMMARY OF THE INVENTION

Aspects of the invention include a ballast for driving a lamp. In one embodiment, a rectifier connected to a power source is configured to receive electricity from the power source. The rectifier generates a DC bus voltage upon receiving electricity. A driver circuit is configured to receive the DC bus voltage from the rectifier and to generate a lamp voltage to drive the lamp upon receiving the DC bus voltage. A controller is configured to control the driver circuit, monitor a first value corresponding to the DC bus voltage, and additionally monitor a second value corresponding to the lamp voltage. The controller disables the driver circuit for a preset period of time when the controller detects a fault condition. The controller thereafter resets to control the driver circuit to drive the lamp. The controller may also reset when a ratio of the second value to the first value falls below a threshold value. A current reduction circuit is configured to accelerate the controller reset in the event of a fault condition by reducing the second value supplied to the controller in a period of time that is less than the preset period of time. The ratio of the reduced second current value to the first current value falls below the threshold value and the controller resets.

Aspects of the invention further include an emergency lighting system for driving a lamp. In one embodiment, a primary ballast is a ballast as described above. The emergency lighting system further comprises a backup ballast configured to selectively drive the lamp from a backup power source when the primary power source is de-energized. In one embodiment, the backup ballast includes a relay configured to selectively connect the primary power source to the rectifier of the primary ballast when the primary power source is energized. The relay is configured to selectively connect the backup ballast to the lamp when the primary power source is de-energized. The relay is further configured to selectively disconnect the lamp from the driver circuit when the primary power source is de-energized. When the primary power source is energized, the lamp is driven by the primary ballast and the backup ballast relay selectively connects the driver circuit and the lamp. When the primary power source is de-energized, the lamp is driven by the backup ballast and the backup ballast relay selectively disconnects the driver circuit and the lamp. The controller of the primary ballast detects a fault condition due to the disconnect of the driver circuit and the lamp. When the power source is re-energized, the controller resets and the lamp is driven by the primary ballast and the backup ballast relay selectively connects the driver circuit and the lamp.

This summary is provided to introduce a selection of concepts in simplified form that are further described below in the Detailed Description. This summary is not intended to identify key features or essential features of the claimed subject matter, nor is it intended to be used as an aid in determining the scope of the claimed subject matter.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
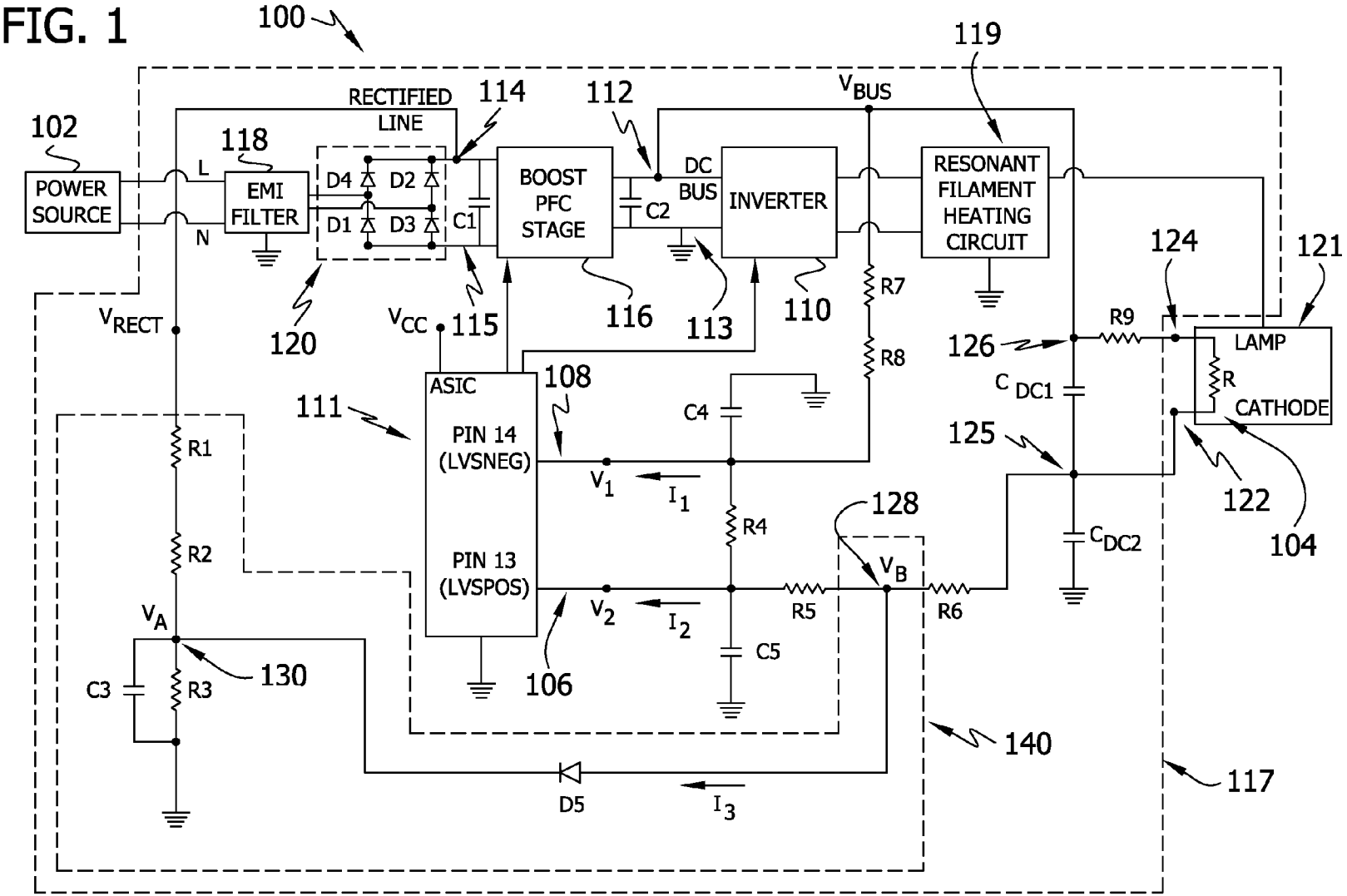
FIG. 1 is a diagram partially in block form and partially in schematic form of an exemplary ballast for driving a lamp according to an embodiment of the invention.

Embodiments of the invention include a ballast 100 for driving a lamp 121. A rectifier 120 connected to a power source 102 is configured to receive electricity from the power source 102 and to generate a DC bus voltage Vbus upon receiving electricity. A driver circuit 117 is configured to receive the DC bus voltage from the rectifier 120 and generate a lamp voltage Vb to drive the lamp 121 upon receiving the DC bus voltage Vbus. The driver circuit 117 is controlled by a controller 111 that monitors a first value 108 corresponding to the DC bus voltage Vbus, and a second value 106 corresponding to the lamp voltage Vb.

In normal operation, the controller 111 resets after a preset period of time after the controller 111 detects a fault condition. A fault condition occurs when a component of the lamp ballast 100 does not behave in an expected manner for any reason. Thus, a fault condition may occur when a component of the lamp ballast 100 suffers a total failure (e.g., the component ceases to function properly and must be replaced by a new, proper functioning component) as well as when a component of the lamp ballast 100 suffers an intermittent transient failure (e.g., the component functions properly, then fails to function properly, but resumes proper functioning without any outside action being taken). A fault condition may thus include, for example, the power source 102 generating a temporary voltage spike, as well as a lamp 121 reaching the end of its life due to degradation of one or more of its internal components or breaking due to an external event. As some other examples, a fault may be one or more of the following: short circuits; shorted or open filaments; open circuits; rectifying lamp loads; arcing; ground-faults; lamp out, end of lamp life (EOLL), lamp removal or lamp failure; electrical disturbances such as power interrupts; asymmetries in the lamp voltage, the lamp current, the bus voltage and the bus current; unstable voltages or currents; unusual start up or lamp ignition voltages or currents; and frequencies, phases, magnitudes of power, voltage or current which are out of a preset range. In general, the fault may be any condition which causes the controller to reset. Those skilled in the art may recognize other fault conditions in addition to the exemplary conditions noted herein.

Frequently, the preset period of time between detecting a fault and the reset by the controller is a defined, fixed period of time. In some embodiments, the preset period of time corresponds to the amount of time needed by the internal control timers of the controller to signal a controller reset. In some embodiments, the preset period of the time is the amount of time required for capacitive discharge. After the preset period times out, a controller reset puts the controller into its initial power-on state to begin a start-up cycle. The invention is directed to shortening the preset period of time in response to a power toggle during the preset period so that the reset is accelerated.

According to embodiments of the invention, a current reduction circuit is provided which, in response to a power toggle, causes the controller to reset prior to the end of the preset period. In particular, the current reduction circuit resets the controller during the preset period. The current reduction circuit, in response to a power toggle, causes the controller to control the driver circuit to drive the lamp regardless of whether the preset period of time has timed out. In normal operation, the controller automatically resets when a ratio of a second value to a first value is less than a threshold value. In some embodiments, the ratio is a ratio of a current corresponding to the DC bus voltage (second value) and a current corresponding to the lamp voltage (first value). The current reduction circuit takes advantage of this automatic reset to reduce the ratio and force an automatic reset before the preset period times out.

According to embodiments of the invention, the controller reset is accelerated by the current reduction circuit connected to a side of the lamp corresponding to the lamp voltage. The current reduction circuit reduces the second value (corresponding to the lamp voltage) supplied to the controller when the power is toggled from ON to OFF to ON. As a result of the current reduction circuit, the ratio of the reduced second current value to the first current value falls below the threshold value, and the controller resets to begin a start-up cycle to control the driver circuit to drive the lamp. Thus, when a fault occurs and the controller is timing out the preset period, a power toggle will cause the current reduction circuit to reset the controller by reducing the second current value.

FIG. 1 illustrates one embodiment of an exemplary lamp ballast 100 of the invention. The ballast 100 is powered by an alternating current ("AC") power source 102. The ballast 100 comprises an optional EMI filter 118, a rectifier 120, an optional boost power factor correction ("PFC") stage 116, a driver circuit 117 including an inverter 110, a controller 111, and a current reduction circuit 140.

The optional EMI filter 118, in some embodiments, conditions the power received from the power source 102, suppressing conducted interference on the power line. In such embodiments, the rectifier 120 then receives the conditioned power from the optional EMI filter 118. In all embodiments, the rectifier 120 receives power (whether conditioned or not) and outputs a rectified direct current ("DC") voltage on a rectified line 114 and a ground 115 for the lamp ballast 100. A capacitor Cl connected between the rectified line 114 and the ground 115 conditions the rectified DC voltage. The optional boost PFC stage 116, in some embodiments, receives the conditioned, rectified DC voltage and outputs a DC bus voltage on a DC bus 112 (alternately referred to as "Vbus"). The DC bus voltage is increased over the rectified DC voltage of the rectified line 114. Advantageously, in some embodiments, a boost PFC stage 116 results in a DC bus voltage of approximately 450 volts. A capacitor C2, connected between the DC bus 112 and ground 113, further conditions the power on the DC bus 112, whether received from the capacitor C1 or the optional boost PFC stage 116. Alternately, in some embodiments, the optional boost PFC stage 116 includes C2.

The DC bus 112 and ground 113 are connected to the inverter 110. In some embodiments, the inverter 110 is a half-bridge inverter 110 receiving the DC power from the DC bus 112 and ground 113 and outputting AC power to a resonant filament heating circuit 119 for driving at least one lamp 121. In some embodiments, the lamp ballast 100 drives a plurality of lamps (not shown). The inverter 110, and in some embodiments, the optional boost PFC stage 116, is controlled to drive the lamp 121 by one or more outputs of the controller 111.

In normal operation, the controller 111 has three operating states. When the controller 111 begins operating, the controller 111 executes a start-up routine, which is referred to herein as the start-up cycle (first operating state). After the start-up cycle, the controller 111 controls the inverter 110 to maintain lamp energization, which is referred to herein as steady state operation (second operating state). When the controller 111 detects a fault, the controller 111 discontinues controlling the inverter 110 to inactivate the ballast 100 for a preset period of time, which is referred to herein as the inactive preset period (third operating state). After the inactive preset period, the controller 111 resets to begin controlling the inverter 110 by executing the start-up cycle (first operating state).

In steady state operation, the controller 111 controls the inverter 110 to provide power to the resonant filament heating circuit 119, which in turn provides power for driving the lamp 121. The lamp 121 includes, among other things, a lamp cathode 104 with a cathode resistance Rcathode, and cathode terminals 122 and 124. Terminal 124 connects to the DC bus 112 via resistor R9. Terminal 122 connects to a terminal of a DC blocking capacitor Cdc1 at connection point 125, with the other terminal connected to R9 at connection point 126. A terminal of DC blocking capacitor Cdc2 connects at connection point 125, with the other terminal connecting to ground. In some embodiments, Cdc2 reduces the voltage at 125 to a value one half that of the DC bus 112 voltage.

In steady state operation, the controller 111 drives the optional boost PFC stage 116, if present, and the inverter 110 when the lamp 121 is operating properly and the cathode 104 is electrically conductive. The controller 111 monitors the current I2 and voltage V2 related to the lamp at input 106 (pin 13) and monitors the current I1 and voltage V1 relating to the bus at input 108 (pin 14). In steady state operation, elements R4, R5, R6, R7, R8, R9, C4, C5, Cdc1, and Cdc2 maintain bus voltage V1, current I1, lamp voltage V2, and current I2 at values such that the ratio of I2 to I1 is greater than a threshold value. The threshold value represents a value below which there is an unacceptable asymmetry between the lamp voltage V2 and the bus voltage Vbus. In particular, when the ratio of the lamp voltage V2 (indicated by the current I2) as compared to the bus voltage V1 (indicated by the current I1) falls below the threshold, an unacceptable asymmetry representative of a fault condition is indicated. For example, a ratio below the threshold may be the result of an unacceptable drop in the magnitude of the bus voltage Vbus, such as a drop due to a power disruption.

Thus, the controller is programmed to operate in the following manner (with or without the current reduction circuit 140) during steady state operation after the start-up cycle. As long as the ratio I2/I1 is greater than a threshold value (e.g., ¾ or 0.75 or higher), the controller 111 continues to control the operation of the inverter 110 to provide power to drive the lamp 121.

In steady state operation after start-up, when the controller 111 detects a fault, the controller 111 discontinues operation of the inverter 110, discontinuing power to drive the lamp 121, and the controller 111 enters the inactive preset period. After the preset period of time passes (i.e., the inactive preset period times out), the controller 111 resets and begins a start-up cycle to restart the ballast 100. In some embodiments as noted herein, there is a need to force a reset during this inactive preset period. As noted below, toggling the power from ON to OFF to ON during the inactive preset period results in the current reduction circuit 140 reducing the I2/I1 ratio and forcing an automatic reset.

The controller 111 begins operation after being OFF, or after the inactive preset period, with a start-up cycle, during which the controller 111 checks the lamp 121 and the lamp ballast 100 for faults. If the controller 111 detects no faults, the controller 111 continues the start-up cycle. As long as no faults occur, when the start-up cycle is complete, the controller 111 proceeds to, and operates in, the steady state cycle.

As noted above, the controller 111 operates in the start-up cycle upon initial power-up of the controller 111 and after reset at the end of the inactive preset period. There is one additional scenario that causes the controller 111 to reset and operate in the start-up cycle. As noted above, the controller 111 analyzes the bus voltage V1 by monitoring the corresponding current I1, and the controller 111 analyzes the lamp voltage V2 by monitoring the corresponding current I2. This monitoring of I1 and I2 allows the controller 111 to determine if other problems (e.g., faults) exist in the lamp 121, such as but not limited to end of lamp life and rectifier effect. Furthermore, the controller 111 monitors the ratio of I2/I1 and expects this ratio to be above a threshold value (e.g., 0.75) in normal operation. In other words, during steady state operation, during the inactive preset period, and during the start-up cycle, the controller 111 is monitoring the ratio I2/I1, and the ratio I2/I1 is normally greater than the threshold value. However, in the event that the ratio falls below the threshold value, the controller 111 responds by immediately resetting and initiating the start-up cycle. Embodiments take advantage of this immediate reset property of the controller 111. In particular, the current reduction circuit 140, when activated by a power toggle (e.g., ON to OFF to ON) will reduce I2 to cause the ratio to fall below the threshold value, and thus force the controller 111 to reset and initiate the start-up cycle. In some embodiments, a controller that operates in this manner is an OS2331418 or ICB2FLOSRAM available from Infineon Technologies, AG of Nuremberg, Germany.

For example, in steady state operation after start-up, if the ratio I2/I1 becomes less than the threshold value, the controller 111 would discontinue operation of the inverter 110 and discontinue power to drive the lamp 121. The controller 111 would immediately reset. After reset, the controller 111 begins the start-up cycle to restart the ballast 100.

As another example, during the inactive preset period after a fault, if the ratio I2/I1 becomes less than the threshold value, the controller 111 would immediately reset and would not wait for the preset period of time to pass (i.e., time out) before resetting. After reset, the controller 111 begins the start-up cycle to restart the ballast 100.

When the controller 111 is operating in steady state operation after start-up in the absence of the current reduction circuit 140, and the controller 111 detects a ballast or lamp fault, e.g. a momentary loss of power, end of lamp life, rectifier effect, etc., the controller 111 inactivates the inverter 110 and begins to time out the inactive preset period. In some embodiments, the inactive preset period of time is 40 seconds. The ratio I2/I1 during the preset period in normal operation continues to be equal to or greater than the threshold value, so that the controller 111 does not reset during the preset period of time.

When the controller 111 is operating in steady state operation after start-up in combination with the current reduction circuit 140, and the controller 111 detects a ballast or lamp fault, e.g. a momentary loss of power, end of lamp life, rectifier effect, etc., the controller 111 inactivates the inverter 110 and begins to time out the inactive preset period. However, if the fault is a power toggle (e.g., OFF to ON to OFF), or if the power toggles during the passing of the preset period, this power toggle activates the current reduction circuit 140. As a result, the current reduction circuit 140 reduces I2, which reduces the I2/I1 ratio to less than the threshold value. This forces the controller 111 to reset and begin a start-up cycle. As noted above, at this point in the start-up cycle, the controller 111 checks the lamp 121 and the lamp ballast 100 for faults and thereafter substantially instantaneously restarts the lamp ballast 100 if no faults are detected.

In summary, when the controller 111 is operating in steady state operation after start-up in the absence of the current reduction circuit 140, in the event the controller 111 detects a fault (e.g., a power disruption or an EOLL fault) followed by a power toggle, the controller 111 resets after timing out the preset period of time. On the other hand, when the controller 111 is operating in steady state operation after start-up in combination with the current reduction circuit 140, in the event the controller 111 detects a fault followed by a power toggle, the current reduction circuit 140 reduces the ratio of I2/I1 below the threshold value, thereby accelerating the reset of the controller 111 in less than the preset period of time.

As a specific example, the following scenario could be a fault followed by the power toggle. The fault may be that power is disrupted, for example, due to a malfunction of the power source 102, which the controller 111 considers a fault because the ratio of the lamp voltage V2 to the bus voltage V1 falls below the threshold value. In response to the detected power disruption, the controller shuts down the driver circuit to begin the timing out of the preset period of time (which may be, for example, forty seconds). In less than the preset period of time (i.e., here, 40 seconds), a user of the ballast 100 toggles the power source 102, causing the current reduction circuit 140 to reduce the I2/I1 ratio below the threshold ratio, which causes an automatic reset of the controller 111. Since the power disruption fault has been cleared, the controller 111 restarts the ballast in less than the preset period of time.

As another example, the following scenario could be a fault followed by a power toggle. The lamp 121 reaches its end of life and the controller 111 detects an end-of-lamp life (EOLL) fault, and shuts down the driver circuit 117 to begin the timing out of the preset period of time (e.g., forty seconds). In less than the preset period of time (i.e., forty seconds), a user of the ballast 100 replaces the lamp 121 to clear the fault, and toggles the power source 102, causing the current reduction circuit 140 to reduce the ratio of I2/I1 below the threshold value. This causes the controller 111 to automatically reset. Since the EOLL fault has been cleared, the controller 111 restarts the ballast 100 in less than the time of the preset period of time (i.e., 40 seconds). In less than the preset period of time (i.e., 40 seconds), if a user does not replace the lamp 121 and toggles the power source 102, this would cause the current reduction circuit 140 to reduce the ratio of I2/I1 below the threshold value, and the controller 111 automatically resets. The controller 111 would restart but, because the EOLL fault has not been cleared, during the start-up cycle the controller 111 would detect the fault and begin to time out the preset period.

Figure 3:
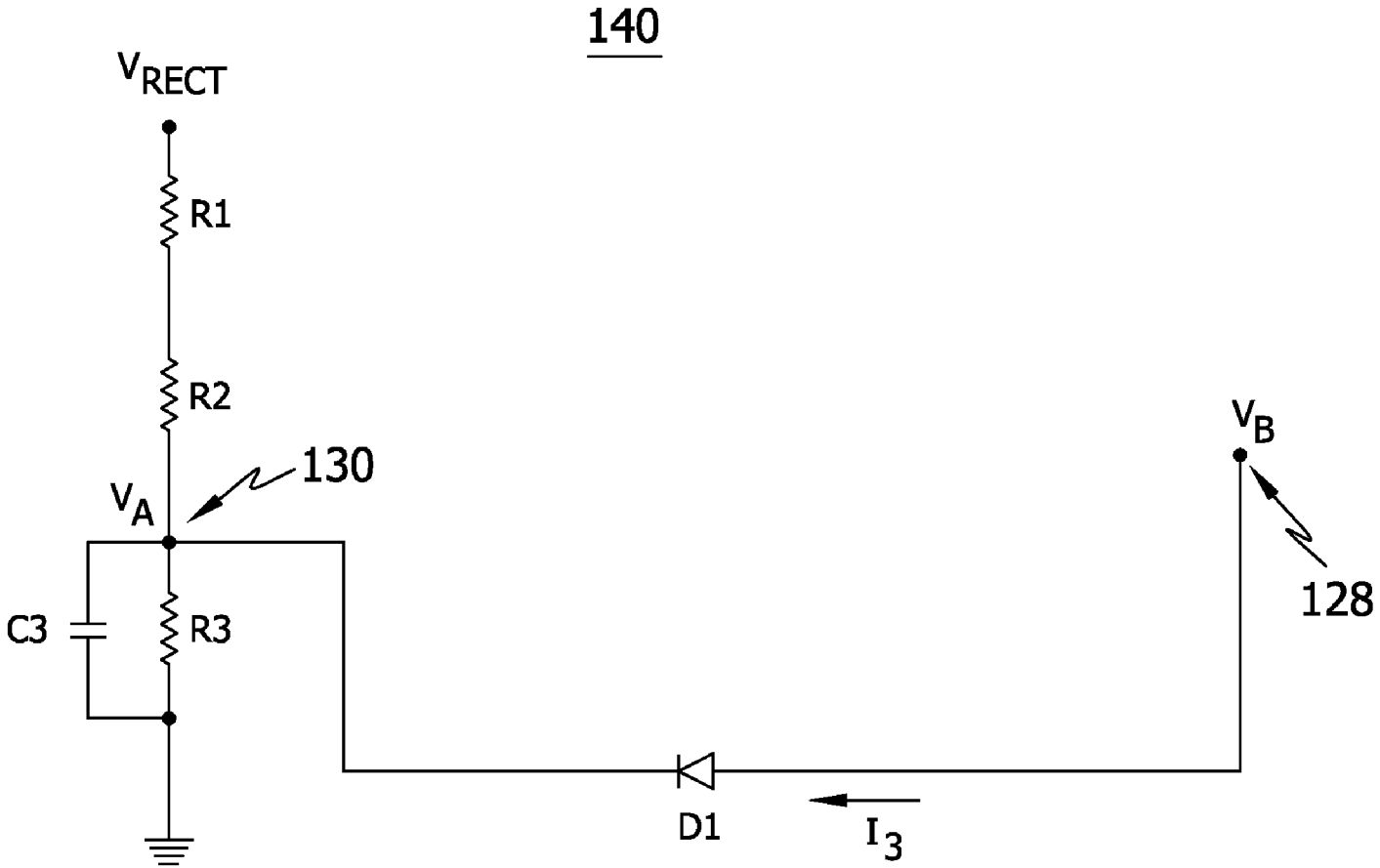
FIG. 3 is a diagram partially in block form and partially in schematic form of an exemplary current reduction circuit for use with the lamp ballast according to an embodiment of the invention.

The current reduction circuit 140 is illustrated as part of the ballast 100 in FIG. 1 and is shown in an isolated, simplified form in FIG. 3. The current reduction circuit 140 comprises an active element D5 with an anode and a cathode, with the anode connected on the side of the lamp 121 corresponding to the lamp voltage Vb at connection point 128. The current reduction circuit 140 further comprises a voltage divider with a first resistance R1/R2 and a second resistance R3 in series, with a first end of the first resistance R1/R2 connected to the rectified line 114 and a second end of the first resistance R1/R2 connected to the cathode of the active element at connection point 130. A first end of the second resistance R3 connects to the cathode of the active element at connection point 130 and a second end of the second resistance R3 connects to a circuit ground. In steady-state operation, the cathode voltage Va is greater than the anode voltage Vb, so that the active element D5 is reversed biased, and does not conduct current. If the cathode voltage Va is less than the anode voltage Vb, e.g., the rectified line 114 voltage drops below the anode voltage Vb, the active element D5 is forward biased, and conducts current.

In some embodiments of the current reduction circuit 140, a diode D5 connects at the connection point 128 and the connection point 130. The diode D5 is connected in such a manner that when the voltage Va is less than the voltage Vb, the diode D5 becomes forward biased and conducts a current I3. A resistance R1 connects with a resistance R2 in series between the rectified line 114 and the connection point 130. One end of a resistance R3 connects at the connection point 130, with its other end connected to the circuit ground. A filter capacitor C3 connects at the connection point 130 and at ground, so that the filter capacitor C3 is in parallel with a resistance R11. Resistances R1, R2, and R3 form a resistive divider that maintains Va<Vb under steady state operation. Upon a power toggle from ON to OFF to ON, the rectified line voltage 114 drops (at power toggle OFF), such that Va=0 volts, and the diode D5 becomes forward biased. The diode D5 conducts a current I3, resulting in an imbalance between I2 and I1, such that the I2/I1 ratio is less than the threshold value. In some embodiments, the current reduction circuit 140 reduces the I2/I1 ratio to a value less than the threshold value within one second or less of a power toggle from ON to OFF to ON.

Figure 2:
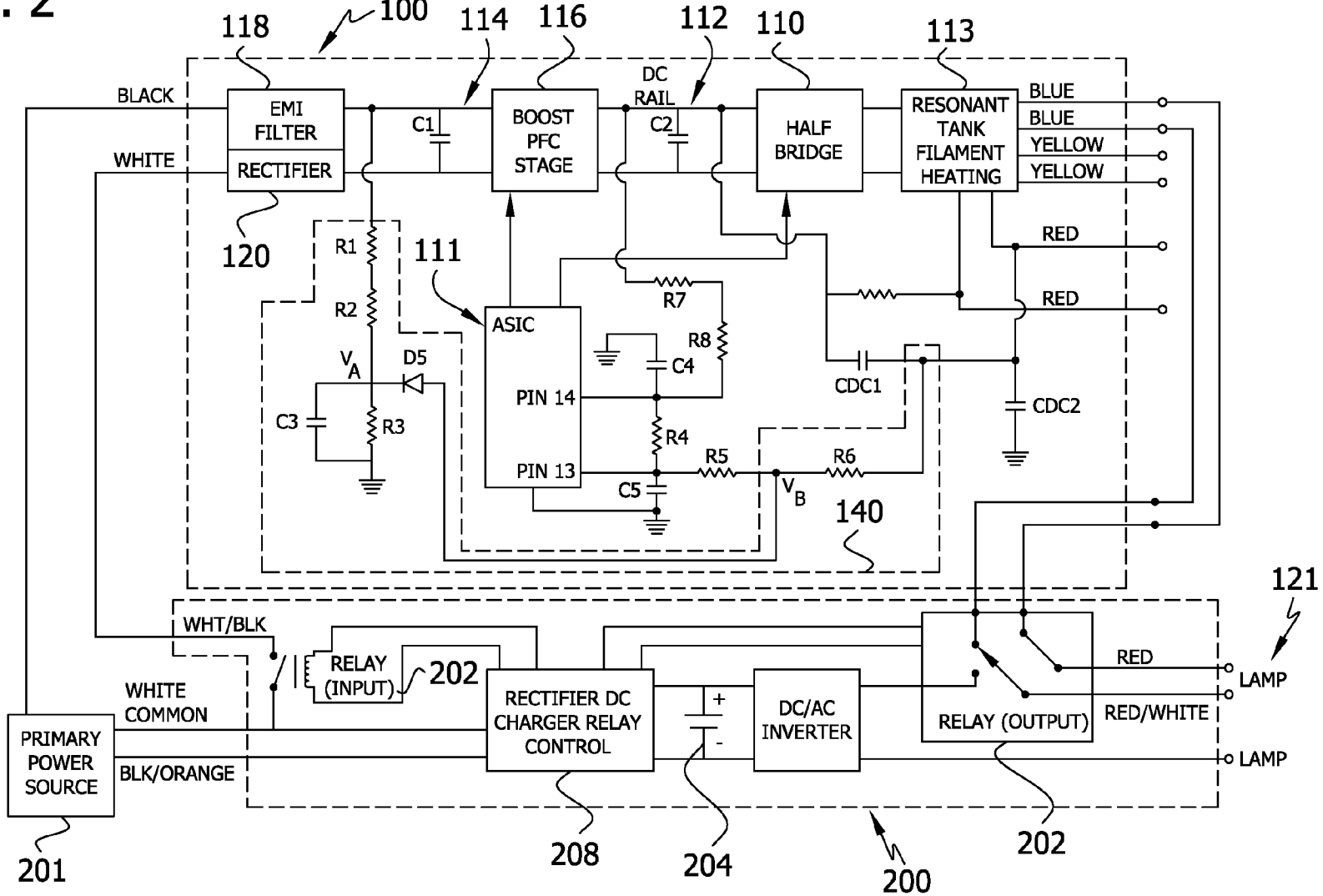
FIG. 2 is a diagram partially in block form and partially in schematic form of an exemplary emergency lighting system comprising a primary ballast and an emergency ballast according to an embodiment of the invention.

FIG. 2 illustrates an embodiment of an emergency lighting system 203. The emergency lighting system 201 includes a primary ballast 100, as described above in regards to FIG. 1, for driving a lamp 121. The emergency lighting system 203 also includes a backup ballast 200. The backup ballast 200 may include, for example, a relay 202, a backup power source 204, and a rectifier/DC charger/relay controller 208. A primary power source 201, while energized, is selectively connected to the primary ballast 100. During normal operation, where the primary power source 201 remains energized, the lamp 121 is selectively connected to and driven by the primary ballast 100 through the relay 202 of the backup ballast.

In the event that the primary power source 201 becomes de-energized, a loss of power occurs and the lamp 121 is selectively driven by the backup power source 204 of the backup ballast 200. The controller 111 of the primary ballast 100 detects a fault due to the lamp disconnection and resets after the preset period of time has timed out (as described above). The voltage on the rectified line 114 drops due to the loss of power, and the current reduction circuit 140 operates to reset the controller 111 in less than the preset period of time (as described above). Once the primary power source 201 has re-energized, the primary power source 201 is again selectively connected to the primary ballast 100 and the lamp 121 is again selectively driven by the primary ballast 100.

Thus, when the primary power source 201 is energized, the lamp 121 is driven by the primary ballast 100 and the backup ballast relay 202 selectively connects the driver circuit 117 and the lamp 121. When the primary power source 201 is de-energized, the lamp 121 is driven by the backup ballast 200 and the backup ballast relay 202 selectively disconnects the driver circuit 117 and the lamp 121, so that the controller 111 detects a fault due to the disconnect of the driver circuit 117 and the lamp 121. When the primary power source 201 is re-energized, the controller 111 resets and the lamp 121 is driven by the primary ballast 100 and the backup ballast relay 202 selectively connects the driver circuit 117 and the lamp 121.

Figure 4:
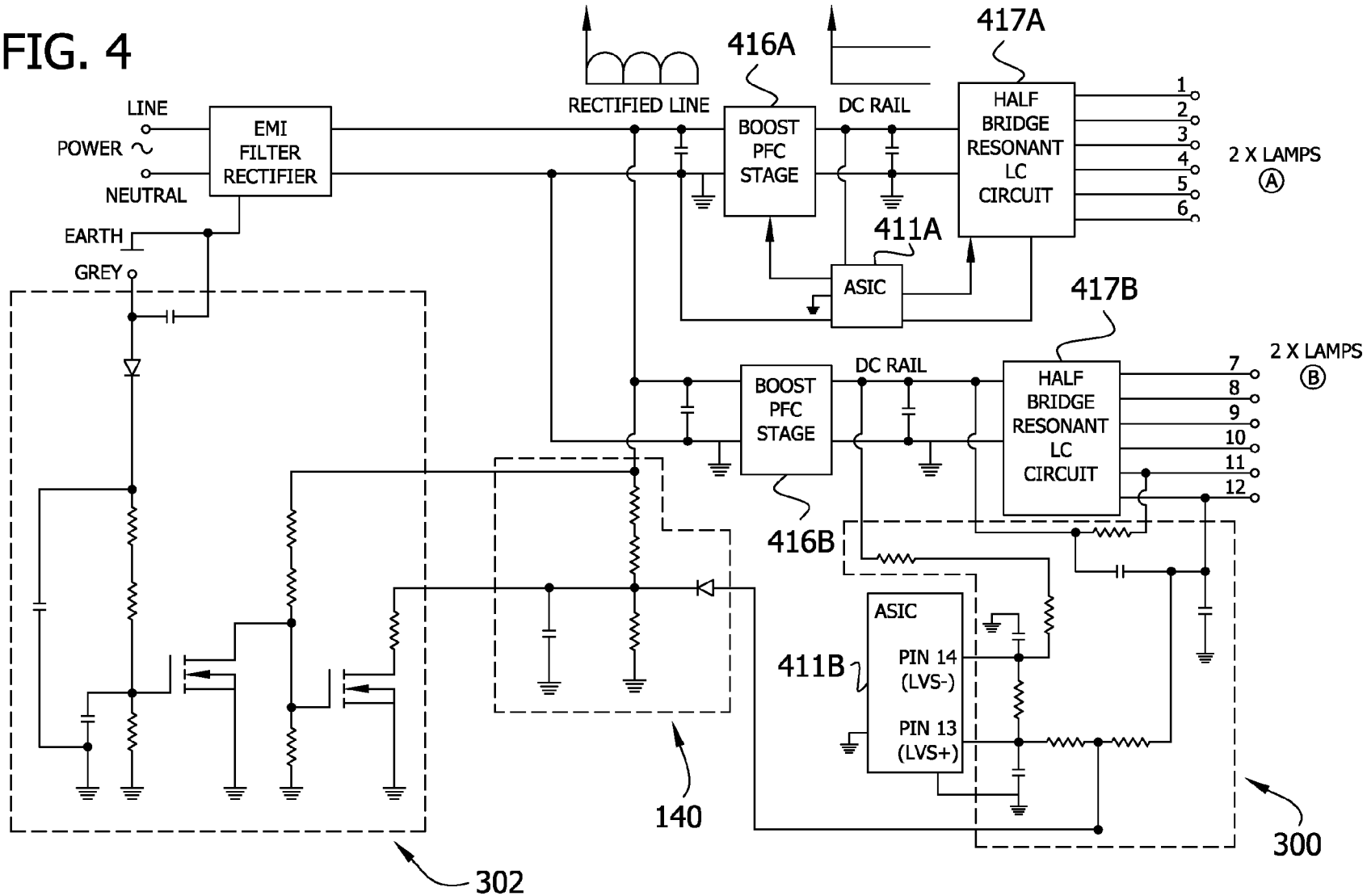
FIG. 4 is a diagram partially in block form and partially in schematic form of an exemplary ballast for driving a lamp, illustrating optional features of the lamp ballast.

The lamp ballast 100 may optionally include a control circuit 302 for selectively operating a lamp driver, as shown in FIG. 4. The control circuit 302 permits the ballast to drive four lamps (not shown) with two stages A and B. Stage A includes a boost power factor control state 416A and combined half bridge resonant LC circuit 417A, both controlled by ASIC 411A, corresponding to the controller 111 described above, for driving two lamps. Similarly, stage B includes a boost power factor control state 416B and combined half bridge resonant LC circuit 417B, both controlled by ASIC 411BA, also corresponding to the controller 111 described above, for driving two lamps. The control circuit 302 further permits the ballast to run in a two lamp operation mode by turning off one of the inverters driving the lamps without removal of the output wires that connect to the lamps. Co-invented and co-owned U.S. patent application Ser. No. 12/474,049, filed simultaneously herewith, entitled Electronic Ballast Control Circuit, is incorporated herein by reference in its entirety, and describes embodiments for the control circuit 302.

The lamp ballast 100 may further optionally include a re-lamping circuit 300, which causes the ballast to restart in response to a user replacing either of a first lamp or a second lamp (not pictured) powered by the ballast, as shown in FIG. 4. Co-invented and co-owned U.S. patent application Ser. No. 12/474,141, filed simultaneously herewith, entitled Relamping Circuit for Dual Lamp Electronic Ballast, is incorporated herein by reference in its entirety, and describes embodiments for the relamping circuit 300.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

Having described aspects of the invention in detail, it will be apparent that modifications and variations are possible without departing from the scope of aspects of the invention as defined in the appended claims. As various changes could be made in the above constructions, systems, products, and methods without departing from the scope of the invention, it is intended that all matter contained in the above description and shown in the accompanying drawings shall be interpreted as illustrative and not in a limiting sense. In view of the above, it will be seen that the several objects of the invention are achieved and other advantageous results attained.

What is claimed is:

1. A ballast for driving a lamp comprising:

a rectifier connected to a power source, the rectifier configured to receive electricity from the power source and to generate a DC bus voltage upon receiving electricity;

a driver circuit configured to receive the DC bus voltage from the rectifier and to generate a lamp voltage to drive the lamp upon receiving the DC bus voltage;

a controller configured to control the driver circuit, said controller to monitor a first value corresponding to the DC bus voltage and to monitor a second value corresponding to the lamp voltage, wherein when the controller detects a fault condition, the controller disables the driver circuit for a preset period of time and thereafter resets to control the driver circuit to drive the lamp, and wherein when a ratio of the second value to the first value falls below a threshold value, the controller resets to control the driver circuit to drive the lamp; and a current reduction circuit configured to accelerate the resetting of the controller in the event of a fault condition, wherein the current reduction circuit reduces the second value supplied to the controller in a period of time that is less than the preset period of time, such that the ratio of the reduced second value to the first value falls below the threshold value, causing the controller to reset.

2. The ballast of claim 1 wherein the current reduction circuit comprises:

a current reduction circuit configured to accelerate the resetting of the controller in the event of a fault condition and in the event that the electricity is toggled from ON to OFF to ON, wherein the current reduction circuit reduces the second value supplied to the controller in a period of time that is less than the preset period of time, such that the ratio of the reduced second current value to the first current value falls below the threshold value, causing the controller to reset.

3. The ballast of claim 1, wherein a ratio of a current corresponding to the second value and a current corresponding to the first value is maintained at or above the threshold value when no fault is detected by the controller and the power source is supplying electricity to the rectifier.

4. The ballast of claim 1, wherein the current reduction circuit is connected to a side of the lamp corresponding to the lamp voltage for accelerating the resetting of the controller, said current reduction circuit comprising:

an active element with an anode and a cathode, said anode connected on the side of the lamp corresponding to the lamp voltage;

a voltage divider with a first resistance and a second resistance in series, wherein a first end of the first resistance is connected to the rectified line and a second end of the first resistance is connected to the cathode of the active element, wherein a first end of the second resistance is connected to the cathode of the active element and a second end of the second resistance to connected to a circuit ground;

wherein the active element is reversed biased and not conducting current when the power source is energized and the cathode voltage is greater than the anode voltage; and wherein the active element is forward biased and conducting current when the power source is de-energized and the cathode voltage is less than the anode voltage.

5. The ballast of claim 4, wherein the forward biased active element conducts current away from the side of the lamp corresponding to the lamp voltage, reducing a first current value, whereby a ratio of the reduced first current value and a second current value falls below the threshold value, causing the controller to reset.

6. The ballast of claim 4, wherein a filter capacitor is connected in parallel to the second resistance, a first end of a filter capacitor is connected to the first end of the second resistance, and a second end of the filter capacitor is connected to the second end of the second resistance.

7. An emergency lighting system for driving a lamp, said system comprising:

a primary ballast for driving a lamp comprising:

a rectifier connected to a primary power source, the rectifier configured to receive electricity from the power source and to generate a DC bus voltage upon receiving electricity;

a driver circuit configured to receive the DC bus voltage from the rectifier and to generate a lamp voltage to drive the lamp upon receiving the DC bus voltage;

a controller configured to control the driver circuit, said controller to monitor a first value corresponding to the DC bus voltage and to monitor a second value corresponding to the lamp voltage, wherein when the controller detects a fault condition, the controller disables the driver circuit for a preset period of time and thereafter resets to control the driver circuit to drive the lamp, and wherein when a ratio of the second value to the first value falls below a threshold value, the controller resets to control the driver circuit to drive the lamp; and a current reduction circuit configured to accelerate the resetting of the controller in the event of a power toggle, wherein the current reduction circuit reduces the second value supplied to the controller in a period of time that is less than the preset period of time, such that the ratio of the reduced second value to the first value falls below the threshold value, causing the controller to reset; and a backup ballast configured to selectively drive the lamp from a backup power source when the primary power source is de-energized, said backup ballast including a relay configured to selectively connect the primary power source to the rectifier of the primary ballast when the primary power source is energized, to selectively connect the backup ballast to the lamp when the primary power source is de-energized and to selectively disconnect the lamp from the driver circuit when the primary power source is de-energized;

wherein when the primary power source is energized, the lamp is driven by the primary ballast and the backup ballast relay selectively connects the driver circuit and the lamp;

wherein when the primary power source is de-energized, the lamp is driven by the backup ballast and the backup ballast relay selectively disconnects the driver circuit and the lamp, so that the controller detects a fault condition due to the disconnect of the driver circuit and the lamp; and wherein when the power source is re-energized, the controller resets and the lamp is driven by the primary ballast and the backup ballast relay selectively connects the driver circuit and the lamp.

8. The emergency lighting system of claim 7, wherein when the power source is re-energized in a period of time that is less than the preset period of time, the current reduction circuit reduces the ratio to less than the threshold value to reset the controller resulting in the lamp being driven by the primary ballast.

9. The emergency lighting system of claim 7, wherein a ratio of a current corresponding to the second value to a current corresponding to the first value is maintained at or above the threshold value when no fault condition is present and the primary power source is energized.

10. The emergency lighting system of claim 7, wherein the current reduction circuit connected to a side of the lamp corresponding to the lamp voltage for accelerating the resetting of the controller comprises:

an active element with an anode and a cathode, said anode connected on the side of the lamp corresponding to the lamp voltage;

a voltage divider with a first resistance and a second resistance in series, wherein a first end of the first resistance is connected to the rectified line and a second end of the first resistance is connected to the cathode of the active element, wherein a first end of the second resistance is connected to the cathode of the active element and a second end of the second resistance to connected to a circuit ground;

wherein the active element is reversed biased and not conducting current when the power source is energized and the cathode voltage is greater than the anode voltage; and wherein the active element is forward biased and conducting current when the power source is de-energized and the cathode voltage is less than the anode voltage.

11. The emergency lighting system of claim 10, wherein the forward biased active element conducts current away from the side of the lamp corresponding to the lamp voltage, reducing a first current value, whereby the ratio of the reduced first current value and a second current value falls below the threshold value, causing the controller to reset.

12. The emergency lighting system of claim 10, wherein a filter capacitor is connected in parallel to the second resistance, a first end of a filter capacitor is connected to the first end of the second resistance, and a second end of the filter capacitor is connected to the second end of the second resistance.

* * * * *